US005546988A

United States Patent [19]

Perkey et al.

[11] Patent Number: 5,546,988

[45] Date of Patent: Aug. 20, 1996

[54] SERVO MULTIPLEXING SYSTEM

[75] Inventors: Russell C. Perkey; Bruce S. Ramey, both of Granger, Ind.; George S. Wieger, Niles, Mich.

[73] Assignee: AlliedSignal Inc., Morristown, N.J.

[21] Appl. No.: 311,075

[22] Filed: Sep. 23, 1994

[51] Int. Cl.[6] ..... F15B 13/06

[52] U.S. Cl. ..... 137/625.66; 91/524; 91/529; 137/596.15; 137/596.16

[58] Field of Search ..... 91/524, 526, 529; 137/596.15, 596.16, 625.66

[56] References Cited

U.S. PATENT DOCUMENTS 3,070,295 12/1962 Glatti .
3,533,446 10/1970 Kirk .
3,578,025 5/1971 Furrer .
4,622,998 11/1986 Kussel et al. ..... 137/596.15
4,848,404 7/1989 Hickok .
5,048,394 9/1991 McLevige et al. ..... 137/625.11
5,056,600 10/1991 Surjaatmadja et al. ..... 166/373

*Primary Examiner*—Gerald A. Michalsky
*Attorney, Agent, or Firm*—Leo H. McCormick, Jr.; Larry J. Palguta

[57] ABSTRACT

Fluidic control of a number of remote functions is achieved by a single servo controlled linearly actuated distribution valve (29) in conjunction with a like number of bistable hydraulically actuable holding relays (17,19,21) the individual states of which are controlled by the distribution valve. Each holding relay supplies one of two pneumatic signals to an associated remote device (11,13,15). Holding relay or distribution valve motion is only required when a change in a remote function is required. The distribution valve is also adapted to provide a fail-safe signal (79) to all remote devices simultaneously to set the individual remote functions to a desired safe condition.

19 Claims, 3 Drawing Sheets

SERVO MULTIPLEXING SYSTEM

BACKGROUND OF THE INVENTION

The present invention relates generally to the fluid control of a plurality of remotely located devices. In a preferred embodiment, a single servo controlled distribution valve distributes an independent hydraulic or pneumatic signal to selected remote locations as part of an aircraft engine management system. The distribution valve acts through individual fluidic holding relays near the distribution valve.

Typical systems for fluidically controlling a plurality of diverse remote functions employ multiple hydraulic or pneumatic signal generators. In the illustrative aircraft engine management system, typical remote functions are turbine tip clearance, fuel or lubricant heating or cooling, chamber temperature control, and metered fuel distribution between engines.

SUMMARY OF THE INVENTION

Among the several objects of the present invention may be noted the provision of a single fluidic signal generator with a servo controlled distribution valve to replace multiple fluidic signal generators; and the provision of a servo multiplexing system for controlling a plurality of remote variable position devices; the provision of a bistable holding relay the extreme positions of which are determined by a pneumatic valve which is actuated by the holding relay. These as well as other objects and advantageous features of the present invention will be in part apparent and in part pointed out hereinafter.

In general, a fluidic control system provides for the control of a plurality of remotely located fluidically actuated devices by selectively changing the state of individual ones of a plurality of bistable fluidic holding relays. Each holding relay is associated with a corresponding device. A common distribution valve is momentarily selectively operable to change the state of any one of the holding relays.

Also in general and in one form of the invention, a fluidically actuated, fluidically latched bistable control valve has a housing containing a piston with first and second opposed piston faces. The piston faces and housing together define first and second variable volume chambers. The piston is reciprocal within the housing between first and second stable positions. The first variable volume chamber receives a low pressure holding fluid when the piston is in the first stable position and a high pressure holding fluid when the piston is in the second stable position. Fluidic control signals, either a low fluid pressure switching signal or a high fluid pressure switching signal, are supplied to the first variable volume chamber to switch the control valve from one stable state to the other. A valve member is movable with the piston for delivering a first fluid pressure to a remotely located device when the piston is in one stable state and a second fluid pressure to the device when the piston is in the other stable state

DETAILED DESCRIPTION OF THE INVENTION

Figure 1:
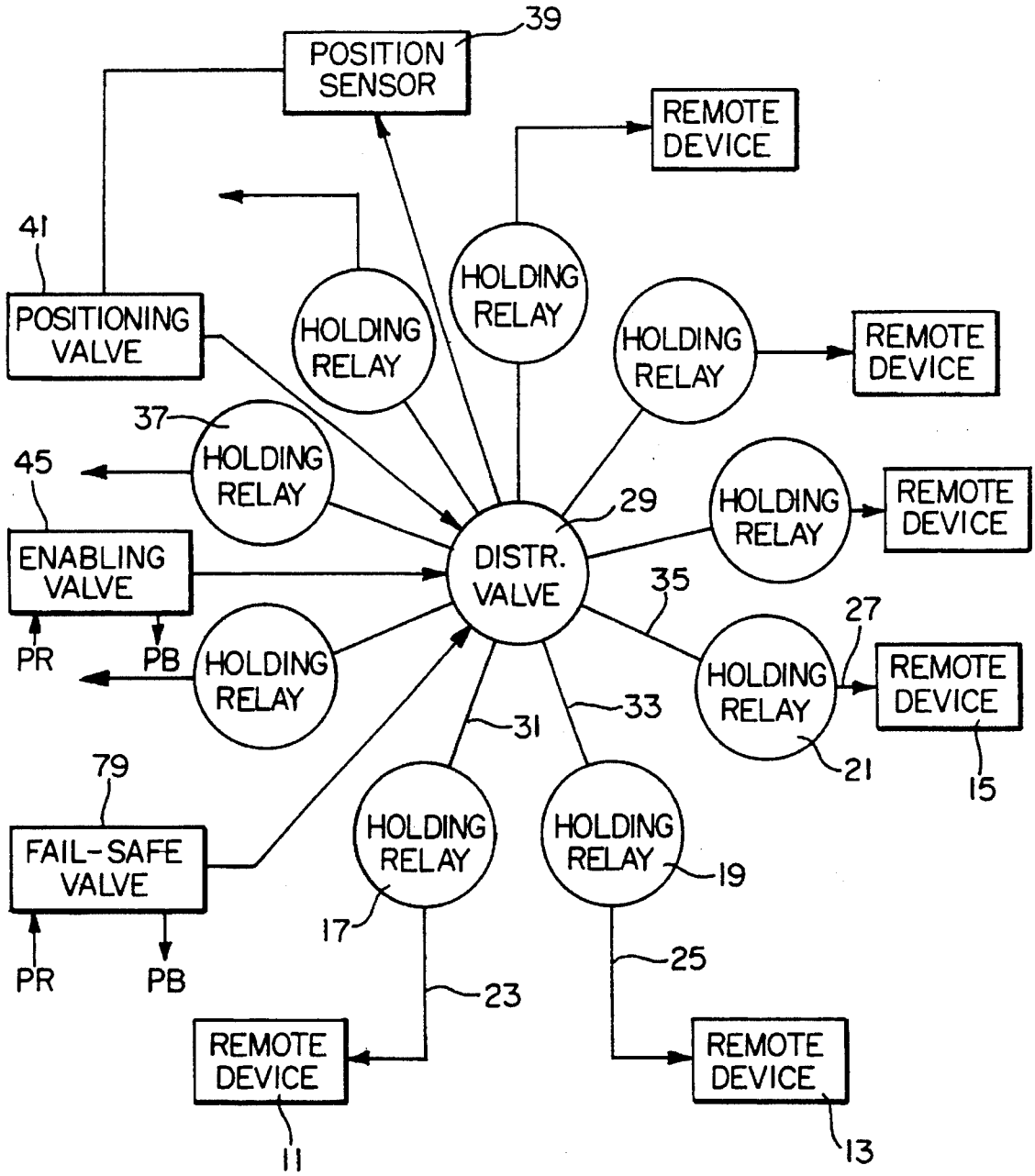
FIG. 1 is a schematic representation of the servo-multiplexing system for controlling the relationship to a plurality of remote devices.

Corresponding reference characters indicate corresponding parts throughout the several views of the drawing.

In FIG. 1, a fluidic control system has a number of remotely located pneumatically actuated devices such as 11, 13 and 15 each associated with a function such as fuel or lubricant heating or cooling, chamber temperature control, and the like. Each of these remote devices is connected to a bistable hydraulically actuable holding relay such as 17, 19 and 21. The holding relays control a supply of either high or low pneumatic pressure in lines 23, 25 and 27 for controlling the corresponding remote devices. The state of each holding relay may be changed by either a high or low pressure hydraulic pulse from a distribution valve 29 by way of lines such as 31, 33 or 35.

Figure 2:
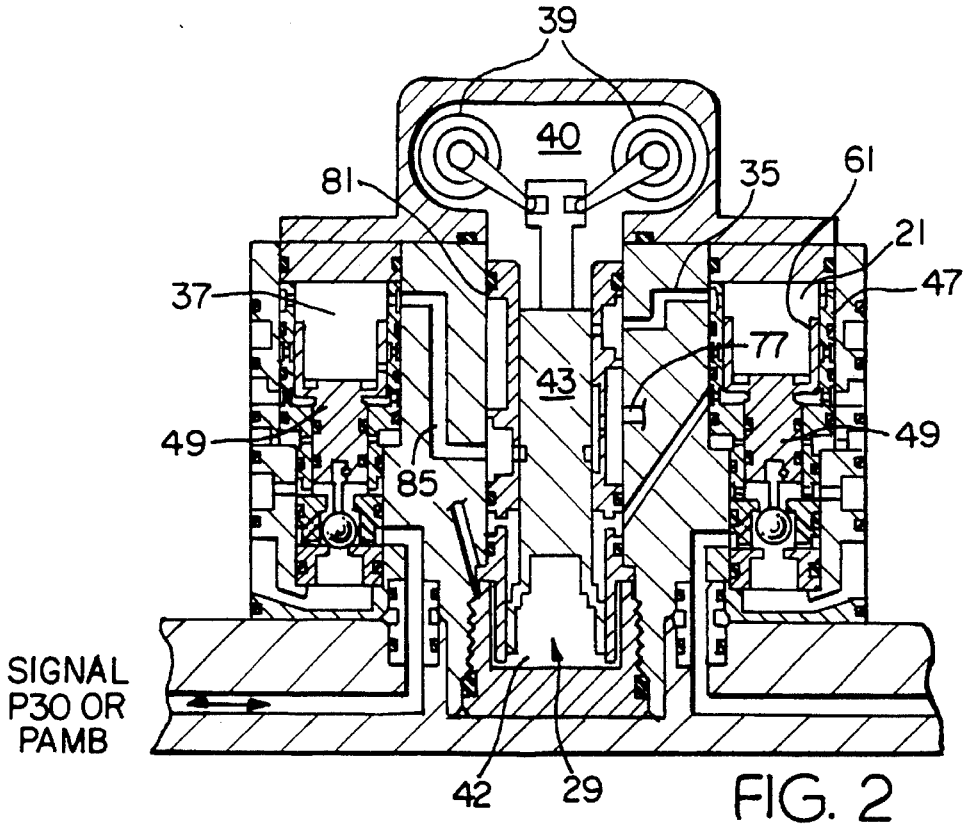
FIG. 2 is a cross-sectional view of the distribution valve, position sensor and a pair of the holding relays of FIG. 1.

The distribution valve 29 is common to all the holding relays and is shown in FIG. 2 closely adjacent to two diametrically opposite holding relays 21 and 37. FIGS. 1 and 2 clearly indicate that the bistable hydraulically actuable holding relays radially surround the distribution valve. A distribution valve 29 is a servo controlled linearly actuated valve the linear position of which is sensed by resolver 39 (FIG. 1). A electrohydraulic valve 41 (FIG. 1) supplies hydraulic fluid to chamber 42 (FIG. 2) of the distribution valve 29 to create a pressure differential with chamber 40 to move piston 43. The position of piston 43 is sensed by resolver 39 and a feedback correction (a reduction n the fluid pressure as applied to chamber 42) is applied by valve 41 as necessary. The axial position of piston 43 determines which, if any, of the holding relays 19, 21, etc. is to receive a pulse of hydraulic pressure from enabling valve 45 (FIG. 1). Thus, electrohydraulic valve 41 linearly positions the distribution valve piston 43, and a electrohydraulic valve 45 is momentarily selectively operable to provide hydraulic set and reset signals to change the state of any one of the holding relays.

Figure 4:
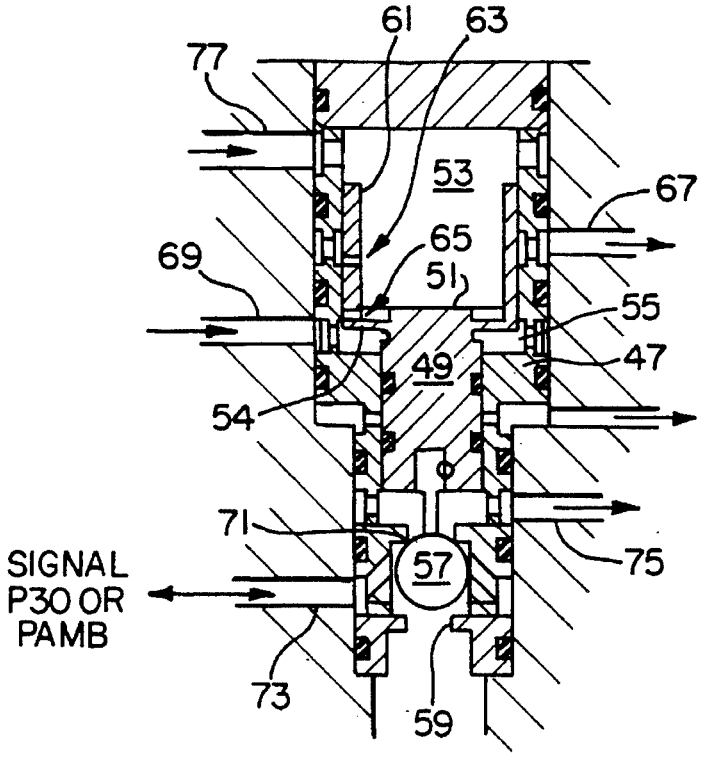
FIG. 4 is a cross-sectional view of one of the holding relays.

Each holding relay includes, as seen in FIGS. 2 and 4, a housing 47, a piston 49 having first 51 and second 54 opposed faces with the piston faces and housing cooperating to define first 53 and second 55 variable volume chambers. The piston 49 is reciprocal within the housing 47 between a first stable position as shown in FIGS. 2 and 4, and a second stable position where the piston 49 is moved toward the bottom of the drawing sheet and the valve ball 57 engages valve seat 59.

The ball 57 is a valve member which moves with the holding relay piston 49 and in conjunction with valve seat 59 and valve seat 71 functions to deliver a first high air pressure (P30) to a remotely located pneumatically actuated device such as 11, 13 or 15 by way of outlet port 73 when the piston is in the illustrated stable state and a second low fluid pressure from vent port 75 to the remote device when the piston is in the other stable state. Engagement of the ball 57 with seats 59 and 71 determines the first and second stable positions ensuring good air seals in each stable state of the holding relay. Thus, the position of the valve ball 57 controls the supply of either high or low pneumatic pressure by way of a line such as 25 or 27 (FIG. 1) to the corresponding remote device. In one preferred form, low pneumatic pressure is simply ambient air pressure.

The piston 49 includes an annular skirt 61 depending from the face 51 and partially into the first variable volume chamber 53. There are a pair of apertures 63 and 65 are located in the skirt. Aperture 63 supplies the low pressure holding fluid (return pressure PB) from port 67 to variable volume chamber 53 when the piston is in the stable position shown while the other aperture 65 will supply the high pressure holding fluid (servo pressure PR) from port 69 to the same variable volume chamber 53 when the piston is in the other stable position. Thus, the apertures allow the variable volume chamber 53 to receive a low pressure holding fluid when the piston is in the illustrated stable position and to receive a high pressure holding fluid when the piston is in the other stable position. The holding fluid may advantageously be aircraft fuel.

Distribution valve 29 is operable to supply either a low hydraulic fluid pressure switching signal or a high pressure switching signal to the variable volume chamber 53 by way of port 77. Piston 49 is held in the position shown since low pressure occupies the chamber 53 while high pressure is being supplied to chamber 55 from port 69. The variable volume chamber 55 receives a continuous supply of high pressure fluid from port 69. A low pressure signal to port 77 will be ineffective to change the relay's state, however, a high pressure signal to port 77 will force the piston downwardly even though the pressures in the chambers 53 and 55 are equal since the effective area of the piston face 51 in the first variable volume chamber exceeds the effective area of the piston face 54 in the second variable chamber. With the piston down and high pressure occupying chamber 53, only a low pressure signal at port 77 will be effective to move the piston back up to the position shown. Hence, the piston 49 will move from one stable position to the other upon receipt of such a fluid pressure switching signal if the pressure of the holding fluid in the variable volume chamber 53 differs from the pressure of the switching signal.

Figure 3A:
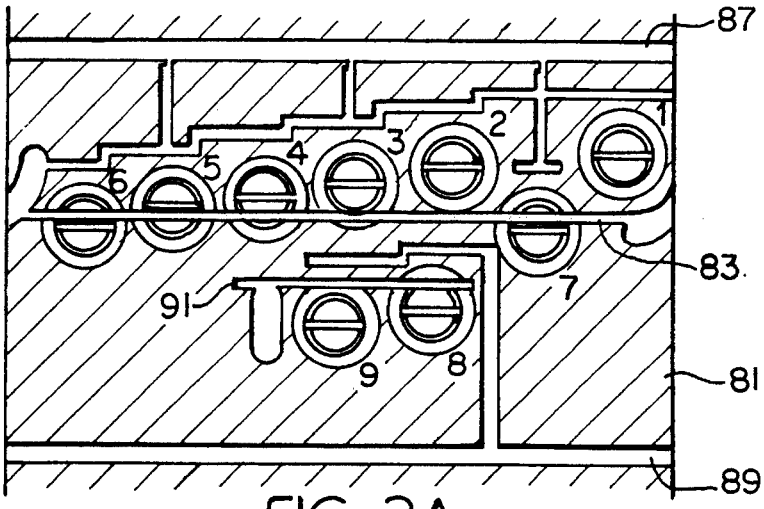
FIGS. 3A, 3B and 3C show the cylindrical interface between the housing and movable piston of the distribution valve.
Figure 3B:
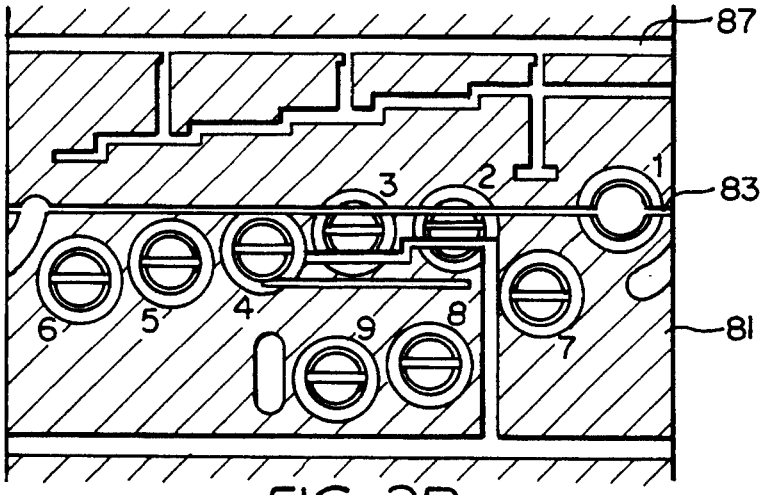
Figure 3C:
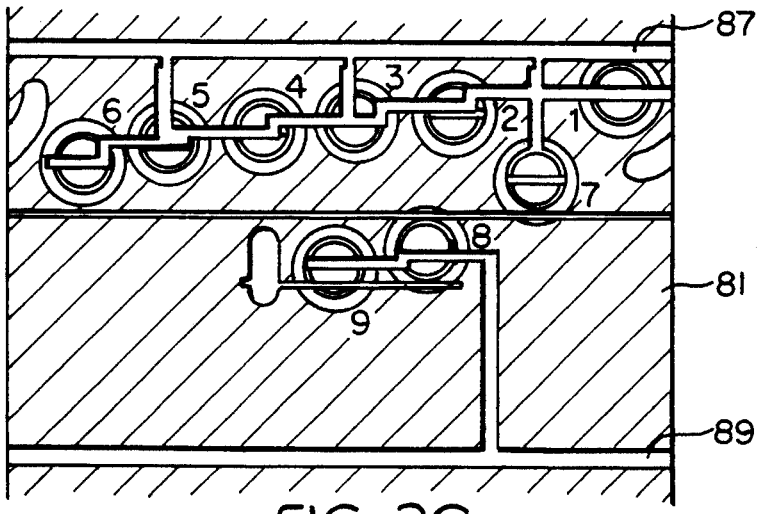

The cylindrical interface between the distribution valve piston 43 and the sleeve 81 in which it moves linearly up and down is shown unrolled in FIGS. 3A, 3B and 3C to illustrate the interaction of the piston 43 grooves 83, 87, 89 and ports. Note that high pressure groove 83 can communicate with at most one port at any given piston location. Each port (arbitrarily numbered 1–9) communicates with a corresponding holding relay by way of lines such as 35 (FIG. 1) and 85 (FIG. 2). In FIG. 3A, the piston 43 is in its starting position with the high pressure fluid groove 83 between ports 5 and 6. Here, none of the ports can receive either high (from groove 87) or low (from groove 89) pressure hydraulic fluid signals. In FIG. 3B, the piston 43 has moved upwardly to allow a high pressure signal to be transmitted to port 1 when the enabling valve 45 provides that signal. FIG. 3C shows the distribution valve in the fail-safe position. In this position, all holding relays are driven to their "safe" condition. In the particular application illustrated, in the preferred fail-safe state, ports 1–7 are enabled by high pressure while ports 8 and 9 are at low pressure. This is in response to a signal from the fail-safe valve 79 of FIG. 1 which, like valves 41 and 45 is under the control of the aircraft electronics system.

The method of operation of the invention should now be clear. For example, to change the position of the remote device 15 (FIG. 1), the electronic control system (not shown) enables the positioning valve 41 to move the piston 43 to the desired port forming a passageway from the enabling valve 45 to the holding relay 21. This position is assured by position sensor 39 and the associated feedback loop. In this position, all other ports are blocked from both high or low pressure grooves 87 and 89. The electronic control system then causes valve 45 to emit a hydraulic pressure pulse signal which is passed by way of line 35 to the port 77. Presuming the chamber 53 to have been at low pressure with the piston 49 in the position shown, the high pressure pulse forces the piston 49 downwardly changing ball valve 57 from its upper seat position to the lower position and opening an air path from the port 73 to the vent or low pressure port 75 and closing off the P30 high pressure opening in the base. Holding pressure fluid is supplied to the chamber 53 by way of aperture 65 and the relay maintains this position until it receives a low pressure signal at port 77. Port 73 is coupled by line 27 to the remote device 15. Air pressure is released from this device causing it to change position.

In summary, the invention has a number of advantages over known prior systems. Wear is minimized since the structural components only move when a change at a remote device is required. Multiple fluidic signal generators are replaced by a single generator whose output is selectively sent to the desired remote device by the distributor. The extreme positions of the holding relays are determined by the seating of their respective pneumatic valves rather than by the structure of the holding valve per se.

What is claimed is:

1. A fluidic control system comprising:

a plurality of remotely located fluidically actuated devices;

a plurality of bistable fluidic holding relays, each connected with a corresponding device; and a distribution valve connected with the plurality of holding relays and momentarily selectively operable to change the state of any one of the holding relays, wherein each holding relay includes a housing, a piston having first and second opposed faces, the piston faces and housing cooperating to define first and second variable volume chambers, the piston being reciprocable within the housing between first and second stable positions, the first variable volume chamber able to receive from the distribution valve a low pressure holding fluid when the piston is in the first stable position and to receive a high pressure holding fluid when the piston is in the second stable position, the distribution valve being operable to supply one of a low fluid pressure switching signal and a high fluid pressure switching signal to the first variable volume chamber, and a valve member movable with the piston for delivering a first fluid pressure to a remotely located fluidically actuated device when the piston is in one stable state and a second fluid pressure to a remotely located fluidically actuated device when the piston is in the other stable state.

2. The fluidic control system of claim 1, wherein each holding relay is hydraulically actuatable to control the supply of operational pressure to a corresponding device.

3. The fluidic control system of claim 2, wherein the distribution valve is a servo controlled linearly actuated valve, the system further including a first electrohydraulic valve for linearly positioning the distribution valve, and a second electrohydraulic valve selectively Operable to provide hydraulic set and reset signals to a holding relay whereby the state of any one of the holding relays may be changed by appropriately energizing the first electrohydraulic valve to position the distribution valve to select a holding relay and then enabling the second electrohydraulic valve to provide the appropriate signal to change the state of the selected holding relay.

4. The fluidic control system of claim 1, wherein each holding relay is hydraulically actuable to change from one stable state to the other stable state and is hydraulically maintained in each stable state.

5. The fluidic control system of claim 1, wherein the distribution valve is further momentarily operable by way of a signal from fail-safe valve means to simultaneously set each of the relays to a preferred fail-safe state.

6. A fluidically actuated, fluidically latched bistable control valve comprising;

a housing;

a piston having first and second opposed faces, the piston faces and housing cooperating to define first and second variable volume chambers, the piston being reciprocable within the housing between first and second stable positions;

fluidic control signal means for supplying one of a low fluid pressure switching signal and a high fluid pressure switching signal to the first variable volume chamber, the first variable volume chamber able to receive from the fluidic control signal means a low pressure holding fluid when the piston is in the first stable position and to receive a high pressure holding fluid when the piston is in the second stable position; and a valve member movable with the piston for delivering a first fluid pressure when the piston is in one stable state and a second fluid pressure when the piston is in the other stable state.

7. The control valve of claim 6, wherein the valve member determines the first and second stable positions.

8. The control valve of claim 6, wherein the piston moves from one stable position to-the other upon receipt of a fluid pressure switching signal if the pressure of the holding fluid in the first variable volume chamber differs from the pressure of the switching signal.

9. The control valve of claim 6, wherein the effective area of the piston face in the first variable volume chamber exceeds the effective area of the piston face in the second variable chamber.

10. The control valve of claim 9, wherein the second variable volume chamber receives a continuous supply of high pressure fluid.

11. The control valve of claim 6, wherein the control signal means comprises a distribution valve common to a plurality of similar control valves and momentarily selectively operable to change the state of any one of the control valves.

12. The control valve of claim 11, wherein the distribution valve is able to supply high pressure fluid to or vent high pressure fluid from any selected one of the control valves.

13. The control valve of claim 11, wherein the control valve is hydraulically actuated and hydraulically latched, the valve member delivering a first pneumatic pressure when the piston is in one stable state and a second pneumatic pressure when the piston is in the other stable state.

14. The control valve of claim 6, wherein the piston includes a pair of apertures, one aperture supplying the low pressure holding fluid to the first variable volume chamber when the piston is in the first stable position and the other aperture supplying the high pressure holding fluid to the first variable volume chamber when the piston is in the second stable position.

15. The control valve of claim 14, wherein the piston includes an annular skirt depending from the first face and partially into the first variable volume chamber, and the pair of apertures are located in the skirt.

16. A fluidic control system comprising:

a plurality of remotely located pneumatically actuated devices;

a plurality of bistable hydraulically actuable holding relays, each associated with and controlling the supply of pneumatic pressure to a corresponding device, each holding relay including a housing, a holding relay piston having first and second opposed faces with the piston faces and housing cooperating to define first and second variable volume chambers, the piston able to reciprocate within the housing between first and second stable positions;

a respective valve member movable with each holding relay piston for delivering a first fluid pressure to a remotely located pneumatically actuated device when the piston is in one stable state and a second fluid pressure to the remotely located pneumatically actuated device when the piston is in the other stable state; and a distribution valve common to the plurality of holding relays and momentarily selectively operable to change the state of any one of the holding relays, the distribution valve being operable to supply one of a low fluid pressure switching signal and a high fluid pressure switching signal to the first variable volume chamber, the first variable volume chamber able to receive from the distribution valve a low pressure holding fluid when the piston is in the first stable position and to receive a high pressure holding fluid when the piston is in the second stable position.

17. The fluidic control system of claim 16, wherein the distribution valve is a servo controlled linearly actuated valve, the system further including a first electrohydraulic valve for linearly positioning the distribution valve, and a second electrohydraulic valve selectively operable to provide hydraulic set and reset signals to one holding relay whereby the state of any one of the holding relays may be changed by appropriately energizing the first electrohydraulic valve to position the distribution valve to select a holding relay and then enabling the second electrohydraulic valve to provide the appropriate Signal to change the state of the selected holding relay.

18. The fluidic control system of claim 16, wherein the holding fluid is aircraft fuel.

19. The fluidic control system of claim 16, wherein the plurality of bistable hydraulically actuable holding relays radially surround the distribution valve.

* * * * *